United States Patent [19]

Hendrix et al.

[11] Patent Number: 4,613,333

[45] Date of Patent: Sep. 23, 1986

[54] SILICONE DURABLE PRESS TEXTILE TREATMENT PROCESS AND RESULTING PRODUCT

[75] Inventors: James E. Hendrix, Spartanburg, S.C.; John Y. Daniels, Pineville; Taryn M. White, Charlotte, both of N.C.

[73] Assignee: Springs Industries, Inc., Fort Mill, S.C.

[21] Appl. No.: 720,138

[22] Filed: Apr. 5, 1985

Related U.S. Application Data

[63] Continuation-in-part of Ser. No. 529,042, Sep. 2, 1983, Pat. No. 4,549,880.

[51] Int. Cl.[4] ..... B32B 27/26; D06M 15/30; D06M 15/66

[52] U.S. Cl. ..... 8/115.7; 8/116.1; 8/120; 8/DIG. 1; 8/DIG. 12; 8/DIG. 18; 428/447

[58] Field of Search ..... 8/115.51, 115.6, DIG. 1, 8/DIG. 12, DIG. 18, 120, 116.1, 115.7

[56] References Cited

U.S. PATENT DOCUMENTS 4,269,603 5/1981 Worth ..... 8/DIG. 1
4,423,108 12/1983 Kalinowski et al. ..... 428/266

FOREIGN PATENT DOCUMENTS 1123447 8/1968 United Kingdom .

OTHER PUBLICATIONS

Welch et al., Textile Research Journal, 37, 324–333 (1967).

*Primary Examiner*—James C. Cannon
*Attorney, Agent, or Firm*—Bell, Seltzer, Park & Gibson

[57] ABSTRACT

Textile materials containing cellulosic fibers are provided with durable press properties by reacting and crosslinking the cellulosic fibers with a durable press finishing agent consisting essentially of a silicone compound and a silicone fragmentation reactant in an effective amount to fragment the silicone compound when exposed to curing conditions. The fabric is impregnated with a finishing bath containing the durable press finishing agent and the fabric is heated to fragment the silicone compound and react and crosslink the finishing agent with the cellulosic fibers to impart durable press properties to the fabric.

10 Claims, No Drawings

SILICONE DURABLE PRESS TEXTILE TREATMENT PROCESS AND RESULTING PRODUCT

CROSS REFERENCE TO RELATED APPLICATIONS

This application is continuation-in-part of commonly owned copending application Ser. No. 529,042 filed Sept. 2, 1983, now U.S. Pat. No. 4,549,880.

FIELD OF THE INVENTION

This invention relates to a process for treating a textile fabric to obtain durable press and fabric stablization properties and to the resulting durable press textile fabric.

This invention more particularly relates to a textile treatment process for obtaining durable press and fabric stabilization properties and to a treated fabric wherein silicone compounds are used as the finishing agent, and the process and fabric are thus characterized by avoiding the use of formaldehyde or formaldehyde based components.

BACKGROUND OF THE INVENTION

Prior commercial methods for achieving durable press properties in textile fabrics typically have used aminoplast resins, such as glyoxal resin, melamine resin, urons, carbamates and urea formaldehydes as the reactive durable press finishing agents in a treatment process which involves impregnating the fabric with an aqueous solution of the resin, and thereafter drying the fabric and curing and crosslinking the resin. Since these aminoplast resins are all based on formaldehyde, the durable press treatment processes which use these resins result in formaldehyde being evolved from the fabric during the curing operation, and also result in the presence of free formaldehyde in the resulting fabric.

Because of concern over health hazards presented by exposure to formaldehyde, there has been a great deal of recent interest in developing a durable press treatment process which does not involve the use of formaldehyde or formaldehyde based resins and does not result in the presence of formaldehyde in the curing operation or in the resulting fabric. By way of example, recent U.S. patents concerned with nonformaldehyde durable press treatment processes include the following: U.S. Pat. Nos. 4,076,870; 4,116,625; 4,269,602; and 4,269,603.

While these patents disclose various approaches to the elimination of formaldehyde in durable press processing, the processes all have certain limitations or disadvantages which make them undesirable for use on a commercial scale, and hence, insofar as applicants are aware, these processes have not been used commercially to any significant extent. Accordingly, an object of the present invention is to provide a new and improved formaldehyde-free process for obtaining durable press properties in a textile fabric.

The present invention is based upon use of silicone compounds as a durable press agent for producing durable press properties in a textile fabric without the use of formaldehyde or formaldehyde based resins. Silicone polymers have been used heretofore in textile finishing operations as softeners to impart a better hand to the fabric and for imparting water repellent properties. Silicones have also been used in conjunction with aminoplast resins such as those described above in durable press treatment processes as extenders to reduce the amount of aminoplast resin required. Attempts have also been made to use silicone polymers alone for imparting durable press properties to certain types of fabric. Such attempts are disclosed for example in British Pat. No. 1,123,447, Canadian Pat. No. 862,635, and U.S. Pat. No. 4,423,108. In these prior approaches, silicone polymers are applied to the fabric and cured or vulcanized to form a permanent resilient sheath on the textile fibers. Apparently, the resilient flexible nature of the silicone polymer sheath is intended to enhance the crease recovery of the fibers and thereby impart durable press properties. However, these prior approaches have been unsuccessful in providing a silicone based durable press textile treatment for use on textile fabrics containing cellulosic fibers which is suitable for commercial production using conventional paddry-cure techniques.

SUMMARY OF THE INVENTION

In accordance with the present invention, we have discovered how to obtain durable press properties in a textile fabric containing cellulosic fibers with the use of a durable press finishing agent containing silicone compounds and without the presence of any formaldehyde based compounds. Consequently, it is now possible to eliminate the use of formaldehyde or formaldehyde-based resins as the reactive durable press finishing agents, and thereby avoid the undesirable odor and potential hazard of formaldehyde vapors in the work environment of the durable press finishing operation and also avoid the presence of formaldehyde on the durable press finished fabric itself.

In accordance with the treatment process of the present invention, a durable press finishing agent consisting essentially of a silicone compound and a silicone fragmentation reactant is applied to a textile material containing cellulosic fibers and the textile material is then subjected to appropriate curing conditions to fragment the silicone and react and crosslink the finishing agent with the cellulosic fibers of the fabric to impart durable press properties to the fabric.

While silicones have been used heretofore in durable press treatment processes, as noted above, they have been used either as additives in conjunction with other known formaldehyde-based durable press resins, such as aminoplast resins, or to form a resilient silicone polymer sheath or coating around the fibers. The present invention is fundamentally different from these prior approaches in that the durable press finishing agent is a reactive system consisting essentially of a silicone polymer and a silicone fragmentation reactant, and wherein the reactive durable press finishing agent system, under appropriate curing conditions, reacts with and crosslinks the cellulose fibers.

The use of the reactive durable press finishing agent system in accordance with the present invention provides a number of very significant advantages. In addition to eliminating the use of formaldehyde and the problems and potential hazards associated therewith, fabrics treated by the durable press agent and process of the present invention exhibit very significant improvement in fabric properties as compared to conventional durable press processes. In addition to having durable press properties, the fabric exhibits improved properties such as a more luxurious hand, less embrittlement of the fibers and a greater resistance to abrasion and tear.

Some of the features and advantages of this invention having been described, others will become apparent from the following detailed description of the invention and from the accompanying illustrative examples. It is to be understood, however, that the detailed description and examples which follow are for the purpose of illustrating and more completely describing the present invention and how it may be practiced. Persons skilled in the arts applicable to the present invention will be enabled by this disclosure to produce products and practice methods which embody the present invention and yet take forms which may differ from those here particularly described. Accordingly, the description which follows is to be understood broadly as an enabling disclosure directed to persons skilled in the appropriate arts, and is not to be taken as being restrictive upon the scope of the present invention.

DETAILED DESCRIPTION OF THE INVENTION

The textile materials to which the durable press treatment process of the present invention may be applied may include woven, knitted or nonwoven textile fabrics formed either partially or wholly of cellulosic fibers. Cellulosic fibers that may be treated by the process of the present invention include cotton, jute, flax, rayon, cellulose acetate, and blends of such cellulose fibers with synthetic fibers such as nylon, acrylic, and polyester for example.

The two essential active ingredients of the reactive durable press finishing agent system of this invention are a silicone compound and a silicone fragmentation reactant. The finishing agent may also optionally include nonessential additives such as wetting agents, emulsifying agents, etc. which facilitate application and penetration of the finishing agent. Silicone compounds suitable for use in the present invention may be selected from the group consisting of nonfunctional or functional monomeric or polymeric siloxane compounds.

The silicone fragmentation reactant is a compound which, when present in sufficient amounts and subjected to curing conditions such as heating in the presence of the silicone compound, will cause the silicone to degrade or fragment into smaller elements or chains which are highly reactive. The reactive fragments and/or the fragmentation reactant itself will react with and crosslink the cellulose and impart enhanced crease recovery and dimensional stability to the fabric. One suitable class of silicone fragmentation reactants for use in the present invention are acid compounds such as magnesium chloride, zirconium oxychloride, antimony trichloride, sulfonic acids and ammonia capped sulfonic acids. A preferred class of acid reactants for use with the present invention are Lewis acids. Fragmentation of the siloxane compounds may also be accomplished using alkaline materials, such as caustic soda. Peroxides or other free radical initiators may also be used for effecting fragmentation of functional and nonfunctional siloxane compounds. Many of these same compounds have been used heretofore as curing catalysts for conventional durable press resin compositions, and when used for this purpose the compounds function in the conventional manner of a catalyst, in that the presence of a small quantity of the compound affects the rate of a chemical reaction, but the compound remains unchanged after the reaction is completed.

In contrast, the compounds used as silicone fragmentation reactants in accordance with the present invention actually function as a reactant. Under appropriate curing conditions as described more fully herein, the reactive finishing agent system can be caused to react with and crosslink the cellulose fibers to impart durable press properties to the fabric. Tests carried out on fabrics treated in accordance with the present invention have confirmed that the reactive durable press finishing agent system actually reacts with the cellulose hydroxyls to crosslink the cellulose, and that the durable press properties are thus provided by crosslinking rather than by other mechanisms. The fact that cellulose crosslinks are formed by the reactive finishing agent system of this invention has been verified experimentally by dye exclusion tests. Uncrosslinked cellulose will dye to a darker shade than crosslinked cellulose due to the greater accessibility of the dye molecule to the uncrosslinked cellulose. The experimental procedure for such tests is described more fully in Example 1 below.

Tests have also shown that the silicone fragmentation reactant alone will, under curing conditions, crosslink the cellulose. However, the cellulose is unacceptably degraded when treated soley with the reactant and cured. Surprisingly, the silicone fragmentation reactant does not adversely affect the cellulose when the fabric is cured in the presence of both the fragmentation reactant and silicone. This combination results in a formaldehyde-free fabric having enhanced dimensional stability and abrasion resistance, as well as wrinkle recovery and durable press properties.

While not wishing to be bound by any particular theory of the mechanism which occurs in producing the durable press properties in accordance with the present invention, it is believed that under the conditions of curing, the silicone compound, or the fragmentation reactant, or both, react with the cellulose fibers to crosslink the cellulose and thereby impart the durable press properties to the fabric. Where the silicone compound contains reactive functional groups, these reactive functional groups may also contribute to the crosslinking.

Applicants have found that under the conditions of curing in accordance with the present invention, the silicone polymers in the presence of Lewis acid fragmentation reactants, will cleave and form reactive dimethylsiloxane ester fragments which are believed to protect the cellulose substrate from degradation by the high acid concentrations.

A preferred class of siloxane compounds for use in the present invention has a siloxane backbone characterized as follows:

$$Q_wT_xD_yM_z$$

where:

$w=0-10{,}000$
$x=0-10{,}000$
$y=0-10{,}000$
$z=0-10{,}000$ and wherein:

The M unit represents a triorganosiloxane end group of the empirical formula $$R_3SiO_{\frac{1}{2}},$$

the D unit represents a linear diorganosiloxane group of the empirical formula $$R_2SiO_{2/2},$$

the T unit represents a branched organosiloxane group of the empirical formula $RSiO_{3/2}$, and the Q unit represents a branched siloxane group of the empirical formula $SiO_{4/2}$.

Siloxane compounds as characterized above may also include any combination of functionalized siloxane groups (denoted as T', D', or M') and containing reactive functional groups such as carboxy-; ester-; halo-; phenyl-; hydroxy-; epoxy-; methoxy-; allyl-; hydrogen-; acetoxy-; vinyl-; amino-; phosphoro-; phosphono-; sulfato-; sulfono-; etc.

Examples of siloxane compounds within the above class include the following: $D_4$, $D_5$, M'M', M'$D'_2$M', MD'$_4$M, MD$_3$D'$_3$M, M'D$_8$D'M', MD$_8$D'$_3$M, MD$_{20}$D'$_3$M, TD$_{20}$M'$_3$, and TD$_8$M'$_3$ and wherein the functionalized siloxane group (T', D' or M') contains reactive functionalities as described above.

Nonfunctional and functional siloxanes as characterized above may be monomeric, oligomeric or polymeric and either linear, branched or cyclic.

Examples of polymeric siloxane compounds include nonfunctional and organofunctional polysiloxanes including dimethylpolysiloxanes, methylhydrogen polysiloxanes, methylalkyl polysiloxanes methylaryl polysiloxanes, methylfluoroalkyl polysiloxanes, and organofunctional methylpolysiloxanes such as aminoalkylmethyl polysiloxane, cyanoalkylmethyl polysiloxane, haloalkylmethyl polysiloxane, and vinylmethyl polysiloxane.

Examples of monomeric or oligomeric siloxanes include $MeOSi(Me)_2OMe$, $Me_3SiOMe$, $Me_2Si(OMe)_2$, $Si(OMe)_4$, $Si(OEt)_4$, $MeSi(Me)_2OSi(Me)_2Me$, $HOOC—(CH_2)_3—Si(Me)_2—O—Si(Me)_2—(CH_2)_3—COOH$.

Cyclic siloxane oligomers are also attractive for use in the present invention, as these compounds have relatively high boiling points and fragment relatively easily under curing conditions to produce reactive segments for crosslinking with cellulose or for polymerization with other reactive silane segments. Examples of cyclic siloxane oligomers include octamethylcyclotetrasiloxane and decamethylcyclopentasiloxane.

Other organosilicon compounds which may be useful in the present invention include borosiloxanes, aluminosiloxanes, titanosiloxanes, stannosiloxanes, plumbosiloxanes, phosphorosiloxanes, polyorganosilanes, polyorganosilazanes, polyorganosilthianes, polyorganosilalkylenes, and polyorganosilarylenes.

The silicone compound may be applied to the textile material by methods conventionally used in durable press finishing operations. For example, a durable press finishing bath containing a solution, dispersion or emulsion of the silicone compound, together with the silicone fragmentation reactant and other additives such as emulsifying agents or wetting agents may be applied to the textile material by suitable methods such as by dipping, padding, spraying or printing. After application, the fabric is dried and cured.

Curing of the silicone compound on the fabric may be accomplished in any of several ways, such as by application of heat.

Effective results may also be achieved by steaming the impregnated fabric after padding and prior to curing. Steaming in the presence of the fragmentation reactant promotes fragmentation of the siloxane and thereby facilitates reaction and crosslinking of the finishing agent composition with the cellulose. Typically, the steaming may be carried out for several seconds to several (e.g. 10) minutes, followed by drying and curing or by rinsing, drying and curing.

Curing and crosslinking of the silicone durable press finishing agent may be suitably carried out under conditions similar to those used in the curing of conventional aminoplast resin durable press finishing agents. For example, the impregnated textile material may be directed through a heated oven at a temperature of about 250° to 450° F. for a period of time ranging from about 5 seconds to about 10 minutes. Curing and crosslinking may also be carried out by other methods, such as by irradiation of the impregnated fabric (with or without the presence of catalysts or initiators) using an actinic radiation source such as UV or electron beam.

A typical silicone durable press finish bath suitable for use in the present invention may contain the following:

Silicone fluid emulsion—3-30%
Silicone fragmentation reactant—1-15%
Wetting agent—0.5%

As earlier noted, it has been determined that when the silicone durable press finish composition is applied to the fabric and cured in the manner described, it reacts and crosslinks the cellulose to provide durable press properties to the fabric. A test method which has been suitably employed for confirming whether crosslinking occurs on the cellulose involves dyeing the fabric using a relatively large dye molecule. An example of a suitable dye for conducting such tests is SOL-AQUA-FAST-RED-2BL produced by Crompton and Knowles Corporation. The dye molecule penetrates an uncrosslinked structure relatively easily, but has difficulty penetrating a tightly crosslinked structure. Thus the degree of crosslinking will be evidenced by the color of the test samples. The following example describes a dyeing test carried out on fabric samples treated in accordance with the present invention.

EXAMPLE 1

Identical fabric samples were treated by the silicone durable press process of the present invention and with a conventional glyoxal resin durable press finish. A similar fabric sample was also treated with the silicone durable press formulation of the present invention but with the fragmentation reactant omitted. These samples, and an unfinished control sample were boiled in a solution of dye (SOL-AQUA-FAST RED 2BL by Crompton and Knowles Corporation) for approximately ten minutes. The samples were then removed from the dye, rinsed and dried, and the following results were observed:

—DP Resin Control—Slightly Pink
—Unfinished Control—Dark Pink
—Silicone Without Fragmentation Reactant—Dark Pink
—Silicone With Fragmentation Reactant—Medium Pink The unfinished control and the sample treated with silicone without catalyst showed a similar dark pink color indicating that no crosslinking occurred. The sample treated with a conventional durable press resin evidenced a slightly pink color indicating a relatively high degree of crosslinking. The sample treated with the silicone formulation of the present invention with fragmentation reactant showed a medium pink color indicating that crosslinking occurred, but to a lesser extent than with the DP resin control.

The following non-limiting examples illustrate various finishing bath formulations in accordance with the invention and how they may be applied and cured.

EXAMPLE 2

Example 1 was repeated to quantitatively measure the degree of crosslinking as evidenced by the dye exclusion test. Samples of 65% polyester/35% cotton blend woven fabric and 100% cotton woven fabric were treated by the silicone durable press process of the present invention (Formulas E–H below), and for purposes of comparison, similar samples were treated under similar conditions using the same silicone without silicone fragmentation reactant (Formula D). Comparison samples were also prepared by crosslinking the fabric with formalin (Formula A), with a conventional glyoxal resin durable press finishing agent (Formula B), and with a film-forming reactive silicone composition (Ultratex) TM which will condense into a film to coat and sheath the yarns (Formula C). Control samples of each fabric were also prepared which were treated only with water. The finishing formulations are set forth in the following table:

Silicone Durable Press
Dye Test for Degree of Crosslinking

| | Chemical Formulas g/l: | | | | | | | |
|---|---|---|---|---|---|---|---|---|
| Formula | A | B | C | D | E | F | G | H |
| Formalin | 20 | — | — | — | — | — | — | — |
| $MgCl_2$ reactant (47.5%) | 5 | 30 | — | — | 13 | 13 | 13 | 13 |
| Softener | 10 | — | — | — | — | — | — | — |
| Surfactant | 1 | — | — | — | — | — | — | — |
| Glyoxal 40% | — | 120 | — | — | — | — | — | — |
| Silicone 2061 | — | 40 | — | 40 | 40 | 40 | 40 | — |
| $NaH_2PO_4$ | — | — | — | — | 2 | — | — | — |
| $AlCl_3$ (10%) | — | — | — | — | — | — | 2 | — |
| Ultratex WK Silicone | — | — | 35 | — | — | — | — | — |
| Ultratex CAT W | — | — | 3.5 | — | — | — | — | — |
| Ultratex CAT EA | — | — | 7.0 | — | — | — | — | — |

The samples were dyed with SOL-AQUA-FAST RED 2BL and the light reflectance of each sample was measured on a Hunterlab D-54 spectrophotometer. The reflectance readings were compared to the appropriate water control and are expressed in the table below as a percentage lighter than (or darker than) the water control.

| | Percent Lighter (L) or Heavier (H) | | |
|---|---|---|---|
| Formula | Style 638 (65% polyester/ 35% cotton) | Formula | Style 474 (100% cotton) |
| | Standard | Water | Standard |
| A | 71.4 L | Formalin | 25.2 L |
| B | 63.5 L | Glyoxal | 76.9 L |
| C | 6.6 L | Ultratex Silicone | 1.4 H |
| D | 7.1 L | Silicone 2061 | 2.1 L |
| E | 31.5 L | Silicone 2061 $NaH_2PO_4$, $MgCl_2$ | 39.8 L |
| F | 26.3 L | Silicone 2061, $MgCl_2$ | 29.2 L |
| G | 26.4 L | Silicone 2061, $AlCl_3$, $MgCl_2$ | 37.1 L |
| H | 35.0 L | $MgCl_2$ | 33.9 L |

As seen from the above table, samples treated by the silicone durable press treatment process of the invention are dyed significantly lighter than the water control and thus clearly evidence crosslinking of the cellulose, while samples treated with silicone formulations outside the scope of the invention show no significant reduction dye uptake and in some instances actually dyed slightly darker than the water control.

EXAMPLE 3

Samples of a polyester/cotton blend woven fabric were padded to a wet pickup of 50% with finishing formulations as follows:

| Chemicals (g/l.) | A | B | C | D |
|---|---|---|---|---|
| Silicone 1* | — | — | — | 60 |
| Silicone 2* | 40 | 40 | — | — |
| Silicone 3* | — | — | 60 | — |
| Surfactant | .5 | .5 | .5 | .5 |
| $MgCl_2$ reactant (47.5% $MgCl_2$) | 10 | — | 10 | 10 |
| $SbCl_3$ | — | .2 | — | — |

*Silicone 1 = 60% emulsion of 1200 cs silicone fluid
Silicone 2 = 50% emulsion of 1000 cs silicone fluid
Silicone 3 = 50% emulsion of 350 cs silicone fluid The fabrics were dried at 250° F. for one minute and cured at 400° F. for 20 seconds. The fabrics exhibited a 3.5 durable press rating after one and five home washings and exhibited acceptable shrinkage.

EXAMPLE 4

A polyester/cotton blend woven fabric is padded to a wet pickup of 60% with an aqueous finishing formulation containing 60 g/l of Dow Corning 193 silicone (a water soluble silicone glycol copolymer) and 0.4 g/l of aluminum chloride. The fabric is dried at 250° F. for one minute and cured at 400° F. for 20 seconds. The fabrics exhibited significantly improved durable press and shrinkage ratings compared to untreated specimens.

EXAMPLE 5

Example 3 is repeated using an aqueous finishing formulation as follows: 120 g/l SM2061 silicone (a 35% emulsion of a 60,000 cs silicone oil), 20 g/l magnesium chloride, 1 g/l fragmentation reactant (20% $AlCl_3.6H_2O$+hydroxy acid) and 1 g/l. Springswet wetting agent. The fabric is dried at 250° F. for one minute and cured at 300° F. for 5 minutes. The fabrics showed improved durable press and shrinkage ratings.

EXAMPLE 6

Silicone polymers were cured on a textile fabric by free radical grafting of the methyl groups to form a crosslinked durable polymer. Fabrics were padded with finishing formulations as follows; followed by drying and curing as indicated.

| | E | F | G | H |
|---|---|---|---|---|
| Chemicals (g/l.) | | | | |
| 35% 350 cs polydimethylsiloxane | 230 | — | 230 | 230 |
| 35% 10,000 cs polydimethylsiloxane | — | 230 | — | — |
| benzoyl peroxide | 10 | 10 | 10 | — |
| hydrogen peroxide (50% solution) | — | — | — | 10 |
| Conditions | | | | |
| dry (°F.) | 250 | 250 | none | none |
| cure (°F.) | 400 | 400 | 400 | 400 |
| cure time (sec) | 20 | 20 | 20 | 20 |

The fabrics showed improved durable press and shrinkage ratings.

EXAMPLE 7

Silicone polymers were cured on a textile fabric with the use of alkaline compounds to promote fragmentation and form a crosslinked durable product. The fabric was padded with a finishing formulation as follows:

| Chemicals (g/l.) | I | J | K | L | M | N | O |
|---|---|---|---|---|---|---|---|
| GE SM 2061 silicone | 40 | 40 | 40 | 40 | 40 | 40 | 40 |
| 50% caustic | 50 | 100 | 50 | 100 | 50 | 100 | 100 |
| Surfactant | 1 | 1 | 1 | 1 | 1 | 1 | 1 |

The fabrics were then optionally steamed and rinsed, followed by drying and curing as follows:

| Conditions | I | J | K | L | M | N | O |
|---|---|---|---|---|---|---|---|
| wet pick up | 60% | 60% | 60% | 60% | 60% | 60% | 60% |
| steam (minutes) | — | 1 | 1 | 1 | 1 | 5 | 5 |
| rinse | no | no | no | yes | yes | no | yes |
| dry (°F.) | 250 | 250 | 250 | 250 | 250 | 250 | 250 |
| cure (°F.) | 400 | 400 | 400 | 400 | 400 | 400 | 400 |
| cure time (sec) | 20 | 20 | 20 | 20 | 20 | 20 | 20 |

The fabrics exhibited discoloration after curing, but after subsequent washing the discoloration washed out. The fabrics had improved durable press and shrinkage ratings.

EXAMPLE 8

Example 7 was repeated using a finishing formulation containing a Lewis acid as follows:

| | P | Q | R |
|---|---|---|---|
| GE SM 2061 silicone | 40 | 40 | 40 |
| $AlCl_3.6H_2O$ (10% solution) | 0.3 | 1.0 | 2.0 |
| magnesium chloride reactant (47.5% $MgCl_2$) | 13 | 13 | 13 |
| Surfactant | 1 | 1 | 1 |

The fabric was padded to a wet pick up of 60%, followed by steaming 5 minutes, rinsing, drying at 250° F., and curing at 400° F. Fabric samples were also dried and cured as usual without rinsing and steaming. No color problems were observed, and the fabrics had improved durable press and shrinkage ratings.

EXAMPLE 9

Finishing formulations containing 60% emulsions of $D_4$ and $D_5$ silicone polymers were cured on a textile fabric, as follows:

| Chemicals (g/l) | S | T | U | V |
|---|---|---|---|---|
| siloxane (D5) | 25 | 25 | — | — |
| siloxane ($D_4$) | — | — | 25 | 25 |
| magnesium chloride reactant (47.5% $MgCl_2$) | 15 | 13 | 15 | 13 |
| Surfactant | 1 | 1 | 1 | 1 |
| $AlCl_3.6H_2O$ soln. (1 g/10 ml) | — | 3 | — | 3 |

The fabrics were padded at 60% wet pick up, dried at 250° F./30 seconds, and cured at 400° F./20 seconds. All fabric samples cured without discoloration, and showed improved durable press and shrinkage ratings.

EXAMPLE 10

Silicone polymers were applied to a polyester cotton blend woven fabric and cured by electron beam irradiation, using the following formulations:

| Chemicals (g/l) | 1 | 1a | 2 | 2a | 3 | 3a | 4 | 4a | 5 | 5a | 6 | 6a |
|---|---|---|---|---|---|---|---|---|---|---|---|---|
| Silicone 1* | 40 | 40 | — | — | — | — | — | — | — | — | — | — |
| Silicone 2* | — | — | 28 | 28 | — | — | — | — | — | — | — | — |
| Silicone 3* | — | — | — | — | 56 | 56 | — | — | — | — | — | — |
| Silicone 4* | — | — | — | — | — | — | 56 | 56 | — | — | — | — |
| Silicone 5* | — | — | — | — | — | — | — | — | 56 | 56 | — | — |
| Silicone 6* | — | — | — | — | — | — | — | — | — | — | 56 | 56 |
| magnesium chloride reactant | 13 | — | 13 | — | 13 | — | 13 | — | 13 | — | 13 | — |
| $AlCl_3.6H_2O$ (10% solution) | 2 | — | 2 | — | 2 | — | 2 | — | 2 | — | 2 | — |
| Surfactant | 1 | 1 | 1 | 1 | 1 | 1 | 1 | 1 | 1 | 1 | 1 | 1 |

*Silicone 1 - 60,000 centistoke nonfunctional dimethylpolysiloxane
Silicone 2 - 5 centistoke nonfunctional dimethylpolysiloxane
Silicone 3 - low m.w. functional branched fluid $TD_{20}M'_3$ where $M'_3$ is $-\underset{\underset{CH_3}{|}}{\overset{\overset{CH_3}{|}}{Si}}-(CH_2)_3-OH$ Silicone 4 - low m.w. functional branched fluid $TD_{20}M'_3$ where $M'_3$ is $-\underset{\underset{CH_3}{|}}{\overset{\overset{CH_3}{|}}{Si}}-(CH_2)_3-COOH$ Silicone 5 - low m.w. functional branched fluid $TD_{20}M'_3$ where $M'_3$ is $-\underset{\underset{CH_3}{|}}{\overset{\overset{CH_3}{|}}{Si}}-H$ Silicone 6 - low m.w. functional branched fluid $TD_{20}M'_3$ where $M'_3$ is $-\underset{\underset{CH_3}{|}}{\overset{\overset{CH_3}{|}}{Si}}-CH_3$ Fabric samples were padded to a wet pick up of about 60 percent, dried at 250° F./30 seconds; and then irradiated by electron beam radiation at levels of 0, 5, 10 and 20 m Rad. One set of samples was examined following irradiation only, while another set of samples were cured at 400° F. for 20 seconds. It was observed that the irradiated samples were cured. Shrinkage tests and durable press tests showed that the shrinkage decreases with increased irradiation, and the samples with magnesium chloride and aluminum chloride exhibited a better cure, generally.

That which is claimed is:

1. A process of treating textile materials containing cellulosic fibers to provide durable press and fabric stabilization properties, said process comprising applying to the material a durable press finishing agent consisting essentially of a silicone compound and a silicone fragmentation reactant selected from the group consisting of an acid or alkali compound in an effective amount to fragment the silicone compound when exposed to curing conditions, the concentration of said silicone compound in said finishing agent being about 3 to 30 percent by weight and the concentration of said silicone fragmentation reactant being about 1 to 15 percent by weight, and thereafter subjecting the textile material to curing conditions to fragment the silicone compound and react and crosslink the durable press finishing agent with the cellulosic fibers to impart said durable press and fabric stabilization properties to the fabric.

2. A process of treating textile materials containing cellulosic fibers to provide durable press properties, said process comprising impregnating the material with a durable press finishing agent consisting essentially of a siloxane compound and a Lewis acid silicone fragmentation reactant in an effective amount to fragment the silicone compound when exposed to heated conditions, the concentration of said silicone compound in said finishing agent being about 3 to 30 percent by weight and the concentration of said silicone fragmentation reactant being about 1 to 15 percent by weight, and thereafter heating the impregnated textile material to fragment the silicone compound and react and crosslink the durable press finishing agent with the cellulosic fibers to impart said durable press properties to the fabric.

3. A process of treating textile materials containing cellulosic fibers to provide durable press and fabric stabilization properties, said process comprising applying to the material a durable press finishing agent consisting essentially of a silicone compound and a Lewis acid silicone fragmentation reactant in an effective amount to fragment the silicone compound when exposed to curing conditions, the concentration of said silicone compound in said finishing agent being about 3 to 30 percent by weight and the concentration of said silicone fragmentation reactant being about 1 to 15 percent by weight, and thereafter subjecting the textile material to curing conditions to fragment the silicone compound and react and crosslink the durable press finishing agent with the cellulosic fibers to impart said durable press and fabric stabilization properties to the fabric.

4. A process of treating textile materials containing cellulosic fibers to provide durable press properties, said process comprising impregnating the material with a durable press finishing agent consisting essentially of a siloxane compound and an alkali silicone fragmentation reactant in an effective amount to fragment the silicone compound when exposed to heated conditions, the concentration of said silicone compound in said finishing agent being about 3 to 30 percent by weight and the concentration of said silicone fragmentation reactant being about 1 to 15 percent by weight, and thereafter heating the impregnated textile material to fragment the silicone compound and react and crosslink the durable press finishing agent with the cellulosic fibers to impart said durable press properties to the fabric.

5. A process of treating textile materials containing cellulosic fibers to provide durable press properties, said process comprising impregnating the material with a durable press finishing agent consisting essentially of a siloxane compound and a silicone fragmentation reactant in an effective amount to fragment the siloxane compound when exposed to heated conditions, the concentration of said silicone compound in said finishing agent being about 3 to 30 percent by weight and the concentration of said silicone fragmentation reactant being about 1 to 15 percent by weight, steaming the impregnated material to enhance the reaction of the siloxane compound with the cellulosic fibers, rinsing the impregnated and steamed textile material, and thereafter drying and curing the impregnated and steamed textile material to thereby fragment the siloxane compound and react and crosslink the durable press finishing agent with the cellulosic fibers to impart said durable press properties to the fabric.

6. A textile material formed at least partially of cellulosic fibers and which has been treated by the process of claim 1, 2 or 5.

7. A textile material formed at least partially of cellulosic fibers and exhibiting durable press properties, said textile fabric having a durable press finishing agent reacted with and crosslinking the cellulosic fibers and imparting said durable press properties to the fabric, said durable press finishing agent having been provided by a composition consisting essentially of a silicone compound and a Lewis acid silicone fragmentation reactant in an amount sufficient to fragment the silicone compound.

8. A textile material as set forth in claim 7 wherein said silicone compound comprises a monomeric or polymeric siloxane compound.

9. A textile material as set forth in claim 8 wherein said siloxane compound comprises a dimethylpolysiloxane.

10. A textile material formed at least partially of cellulosic fibers and exhibiting durable press properties, said textile fabric having a durable press finishing agent reacted with and crosslinking the cellulosic fibers and imparting said durable press properties to the fabric, said durable press finishing agent having been provided by a composition consisting essentially of a silicone compound and an alkali silicone fragmentation reactant in an amount sufficient to fragment the silicone compound.

* * * * *